US005131109A

United States Patent [19]

Grip et al.

[11] Patent Number: 5,131,109

[45] Date of Patent: Jul. 21, 1992

[54] PONTOON BRIDGE WITH AUTOMATIC HEIGHT ADJUSTING AND LOCKING SYSTEMS

[75] Inventors: Bertil Grip, Färjestaden, S-179 00 Stenhamra; Evert Grip, Vällingby, both of Sweden

[73] Assignee: Bertil Grip, Stenhamra, Sweden

[21] Appl. No.: 598,726

[22] PCT Filed: Apr. 10, 1989

[86] PCT No.: PCT/SE89/00190

§ 371 Date: Oct. 29, 1990

§ 102(e) Date: Oct. 29, 1990

[87] PCT Pub. No.: WO89/10452

PCT Pub. Date: Nov. 2, 1989

[30] Foreign Application Priority Data

Apr. 22, 1988 [SE] Sweden ..... 8801508

[51] Int. Cl.[5] ..... E01D 15/14; B63C 01/02; B63B 01/16

[52] U.S. Cl. ..... 14/28; 114/45; 114/273

[58] Field of Search ..... 14/27, 28, 29; 114/61, 114/45, 345, 259, 263

[56] References Cited

U.S. PATENT DOCUMENTS

| | | | |
|---|---|---|---|
| 129,374 | 7/1872 | Thomas | 14/28 |
| 716,160 | 12/1902 | Williams | 14/28 |
| 981,991 | 1/1911 | Forssel | 14/28 |
| 1,367,115 | 2/1921 | Blondel | 14/28 |
| 2,939,291 | 6/1955 | Schurman | 14/27 X |
| 3,603,276 | 7/0969 | De Lisle | 114/45 |
| 4,312,287 | 1/1982 | Kuo | 114/259 |
| 4,686,920 | 8/1987 | Thomas | 114/45 |
| 4,993,341 | 2/1991 | Merkel | 114/61 |

*Primary Examiner*—Ramon S. Britts
*Assistant Examiner*—Nancy Connolly
*Attorney, Agent, or Firm*—Shapiro and Shapiro

[57] ABSTRACT

A clamped-down bridge comprises a superstructure supported by pontoons, each end of the bridge being fixedly secured to the bottom by means of anchors and anchor cables and clamped down to the expected maximum load by means of sinkers and sink cables. The anchor cables and the sink cables are wound in pairs onto common shafts in such manner that winding up of the sink cables causes unwinding of the anchor cables, and vice versa. The shafts are, by a motion transfer arrangement, connected with each other and with an automatic locking device which allows vertical adjustment of the bridge due to changes in the water level, but which locks against vertical adjustment due to wave action or the bridge being loaded.

9 Claims, 6 Drawing Sheets

PONTOON BRIDGE WITH AUTOMATIC HEIGHT ADJUSTING AND LOCKING SYSTEMS

The present invention relates to a clamped-down bridge comprising a superstructure supported by pontoons, each end of said bridge being fixedly secured to the bottom by means of anchors and anchor cables and clamped down to the expected maximum load by means of sinkers and sink cables, the anchor cables and the sink cables being wound in pairs onto a common shaft in such manner that winding up of the sink cables causes unwinding of the anchor cables, and vice versa.

Bridges or loading platforms are previously known, the outer end of which is clamped down to different levels to correspond to the changes in level of a vessel relative to the water surface in loading or unloading, or to stabilise the bridge against heeling moments when the load is uneven. Such bridges are, however, freely floating or provided with complicated means for adjusting and maintaining the bridge at a correct level relative to, for example, a vessel.

The object of the present invention is to provide a clamped-down bridge which normally acts as a freely floating bridge but, when loaded or in case of transitory changes of the water level such as when subjected to wave action, is automatically locked, and which allows vertical adjustment of the bridge as the water level rises or sinks. This object is achieved by means of a bridge having the features as stated in the characterising clause of claim 1.

The invention will now be explained by means of examples, reference being had to the accompanying drawings in which.

Figure 1:
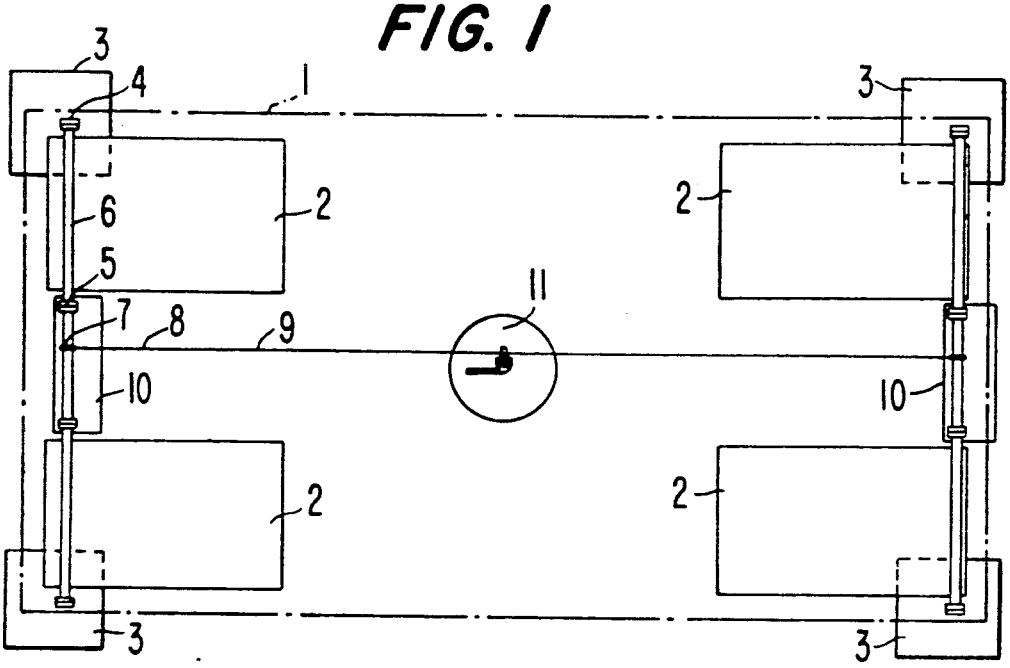
FIG. 1 is a top plan view of a bridge according to the present invention, the superstructure being shown merely by dash-dot lines.
Figure 2:
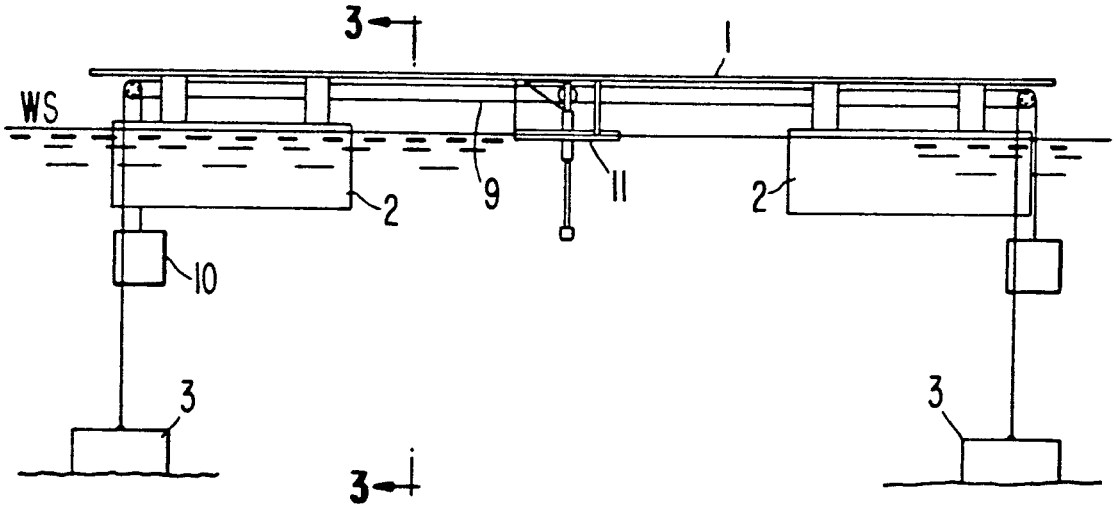
FIG. 2 is a side view of the bridge shown in FIG. 1.
Figure 3:
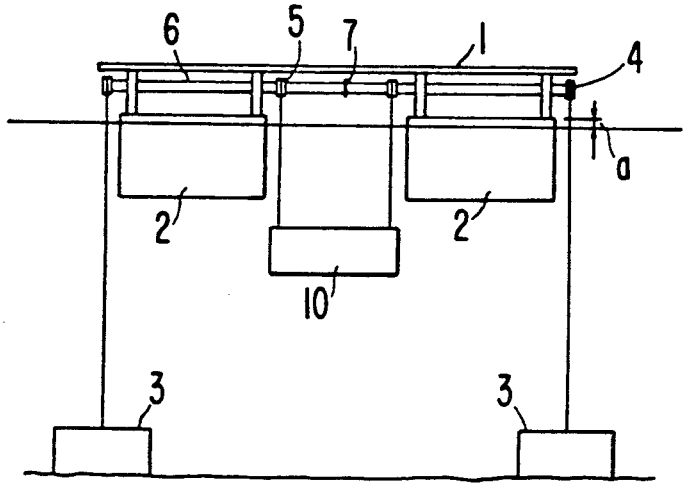
FIG. 3 is an end view of the bridge shown in FIG. 1.

With reference to FIGS. 1-3, the bridge comprises a superstructure 1 which is supported by pontoons 2 which preferably are arranged in each of the corners of the bridge. The bridge is secured to the bottom by means of an anchor 3 arranged in each corner. The anchors 3 are connected with the bridge by anchor cables which are wound in pairs onto pulleys 4 mounted on a shaft 6 which is common to each such pair. On each shaft 6, there are further arranged pulleys 5 for sink cables connected with sinkers 10 which clamp down the bridge to the expected maximum load. To avoid uneven load of the anchor cables and oblique floating of the bridge, the sinkers should be centred on the shafts 6. The anchor cables on the pulleys 4 and the sink cables on the pulleys 5 are wound in opposite directions, so that unwinding of the anchor cables causes winding up of the sink cables, and vice versa. The two shafts 6 are, by means of chain gears 7, chains 8 and cables 9, rotatably connected with one another and with an automatic locking device 11 according to the invention.

Figure 4:
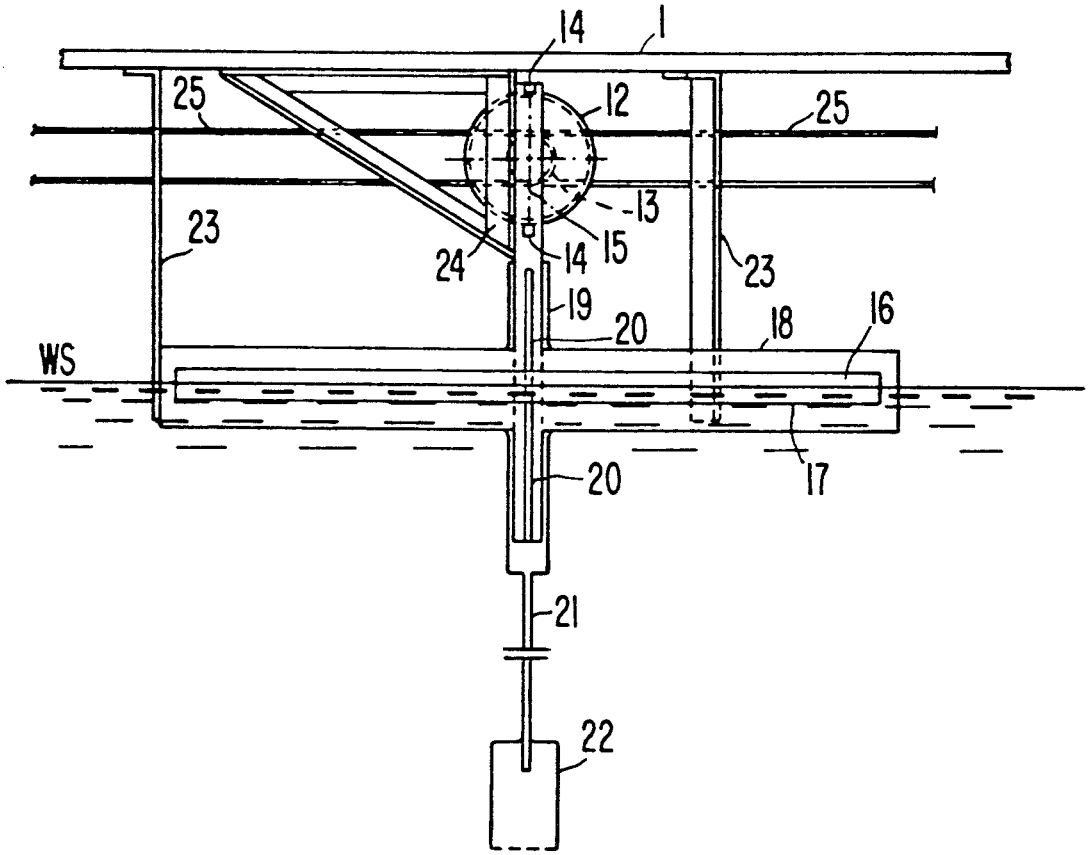
FIG. 4 is an enlarged view of part of the bridge, showing an automatic locking device which is included in the bridge shown in FIG. 1.
Figure 5:
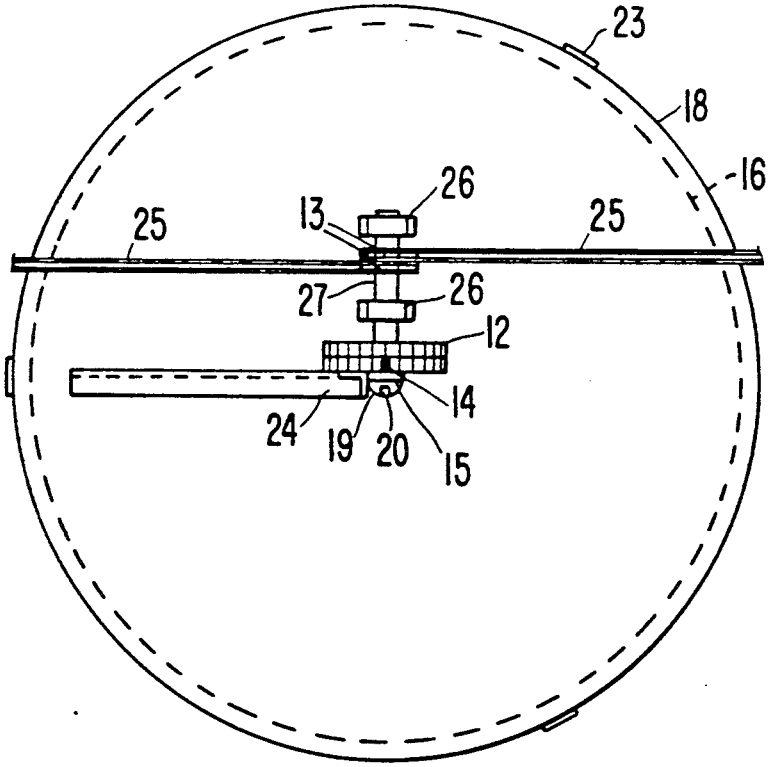
FIG. 5 is a top plan view of the locking device according to FIG. 4.

The automatic locking device 11 is shown in more detail in FIGS. 4 and 5. The locking device comprises two toothed ratchet wheels 12, the teeth of one wheel being opposed to the teeth of the other wheel, and the ratchet wheels being mounted side by side on a shaft 27 which is supported by two bearings 26. On the shaft 27 there are further mounted two chain gears 13 which by means of chains 25 are connnected with the cables 9 and, thus, with the chain gears 7 on the shafts 6. Thus, rotation of one of the shafts 6 causes rotation of the ratchet wheels 12. Moreover, the locking device 11 comprises lock means 14 which are mounted on a common locking bar 15 on vertically opposite sides of the ratchet wheels 12. The locking bar 15 is connected with a float 16 which is provided with a weight 17, such as a metal plate, to give the float the correct buoyancy. The float 16 is mounted in a float casing 18 which by means of suspension mountings 23 is suspended in the superstructure 1 of the bridge. The float casing 18 further contains a pipe 19 which is adapted to ventilate the float casing and provided with guide means 20 for the locking bar 15. The lower part of the pipe 19 is provided with an inlet and outlet pipe 21 which extends vertically downwards and is provided with a sieve 22. An abutment 24 is arranged to absorb the locking pressures occurring in the locking device.

Figure 6B:
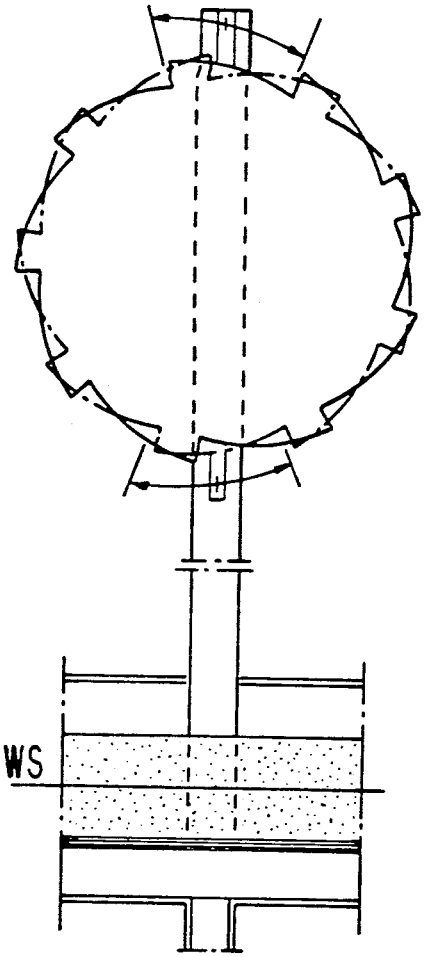
FIGS. 6A-6C illustrate the principle of the function of the locking device, when subjected to wave action.
Figure 6C:
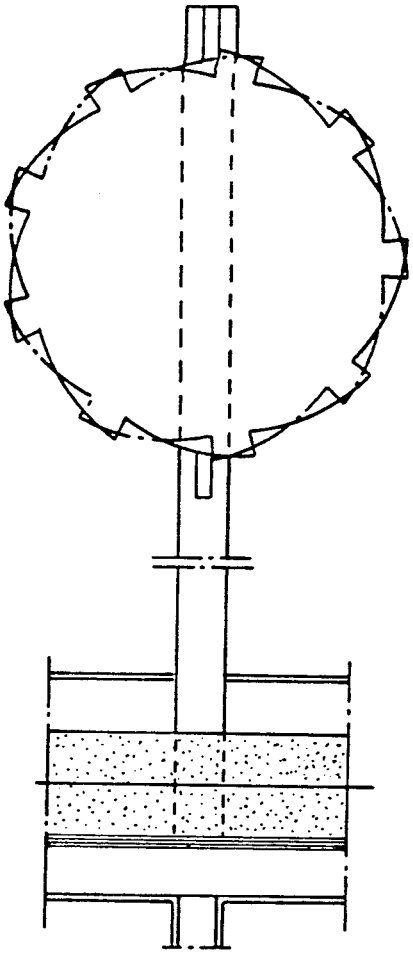
Figure 6A:
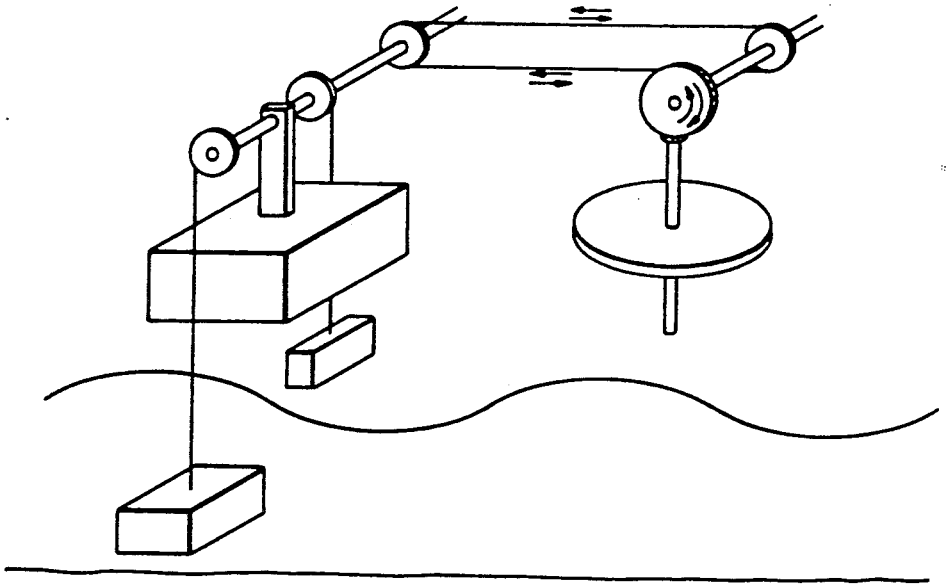

The function of the locking device will now be explained with reference first to FIGS. 6A-6C which show the conditions when the bridge is freely floating, the bridge being loaded only by its own weight in which also the weight of the sinkers is included, or being subjected to wave action. When the bridge is freely floating, the lock means are in one of the positions shown in the FIGS. 6B-6C. As soon as the bridge is subjected to an outer load, i.e. a force which can be directed upwards or downwards, the shaft 6 will be rotated due to the winding or unwinding of the anchor cables onto or from the pulleys 4. The rotary motion of the shaft 6 is transferred by means of the chain gears 7, the chains 8, the cables 9 and the chains 25 to the chain gears 13 on the shaft 27 and, thus, to the ratchet wheels 12. Since the lock means 14 engage with the teeth of the ratchet wheels 12, the bridge is automatically locked against vertical movements and functions as a clamped-down bridge. Under the action of waves, the directions of force and motion change continuously. If the lock means are in the position shown in FIG. 6B when the wave motion starts, the ratchet wheels will therefore always rotate so that the lock means take the position shown in FIG. 6C. As a result, the bridge is locked against motions in both directions. The inlet and outlet pipe 21 should be of such length that its lower end is always positioned under the water surface. The dimension of the pipe should be so small that water in such amounts that the locking positions change, does not manage to flow out or be pressed into the casing of the float in the time it takes for a wave to pass.

Figures 7B, 7C, 7D, 7E:
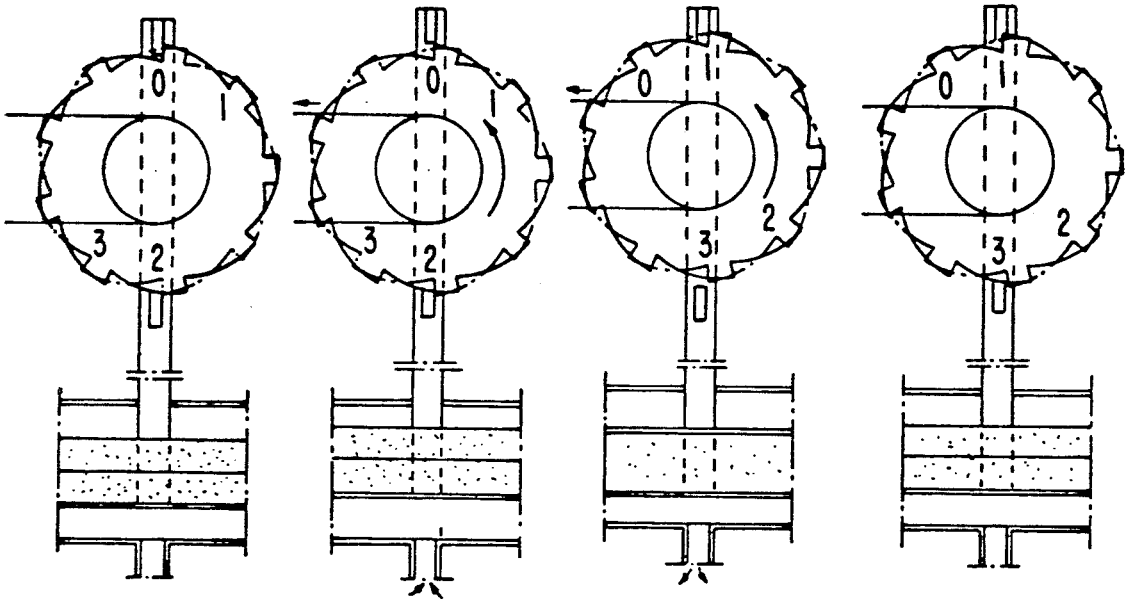
FIGS. 7A-7E show the principle of the function of the locking device as the water level rises.
Figure 7A:
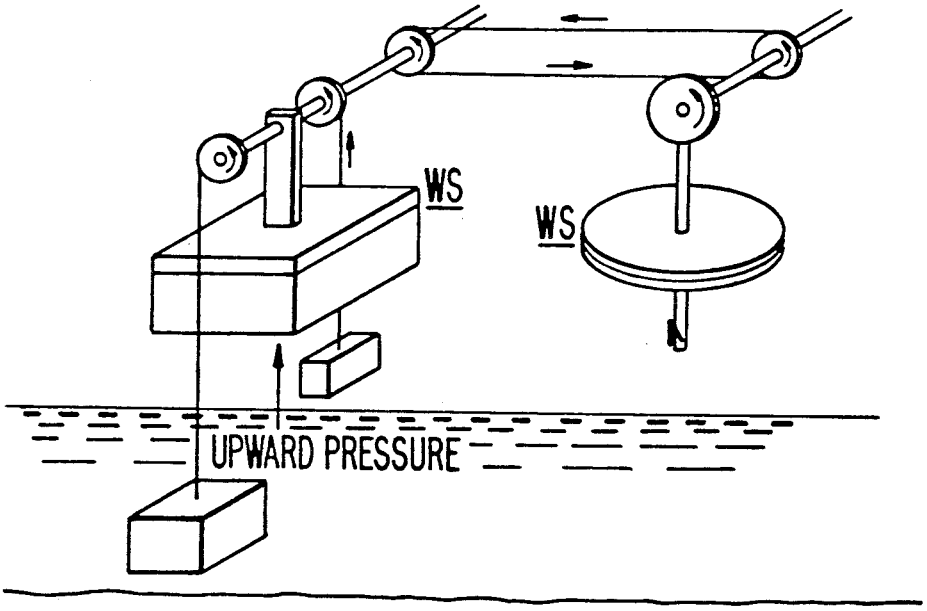

The function as the water level rises is illustrated by FIGS. 7A-7E. FIG. 7B shows a state when the bridge is freely floating and there is no engagement between the lock means and the teeth of the ratchet wheels. FIGS. 7C-7E show what occurs when the water surface rises. The upward pressure under the pontoons causes rotation of the shaft 6 and, thus, the ratchet wheels 12, such that the upper lock means is brought into engagement. As the water surface rises, the float raises the lock means, until the upper lock means is moved out of engagement and the ratchet wheel can begin to rotate (FIG. 7C). The bridge together with the float casing is raised during rotation of the ratchet wheels (FIG. 7D). The float remains on its level of altitude, since the lower lock means is fed downwards by the lower tooth to the same extent as the ratchet wheel rises. Since the float casing rises but not the float, the water in the float casing will on the one hand be pressed out of the pipe 21, but since this is narrow, the water will, on the other hand, also be pressed upwards above the float. During the rotation, the lower lock means will thus be pressed against the lower teeth. When the lower lock means has passed the edge of the teeth, the float is unprevented from rising to the surface, while the excess water in the float casing flows out. The float thus rises to its balanced position and the water surface in the float casing takes the same position as the surrounding water surface (FIG. 7E). The bridge is again freely floating but on a level which has risen by the height of a tooth. As the water surface rises further, the procedure will be repeated.

Figures 8B, 8C, 8D, 8E:
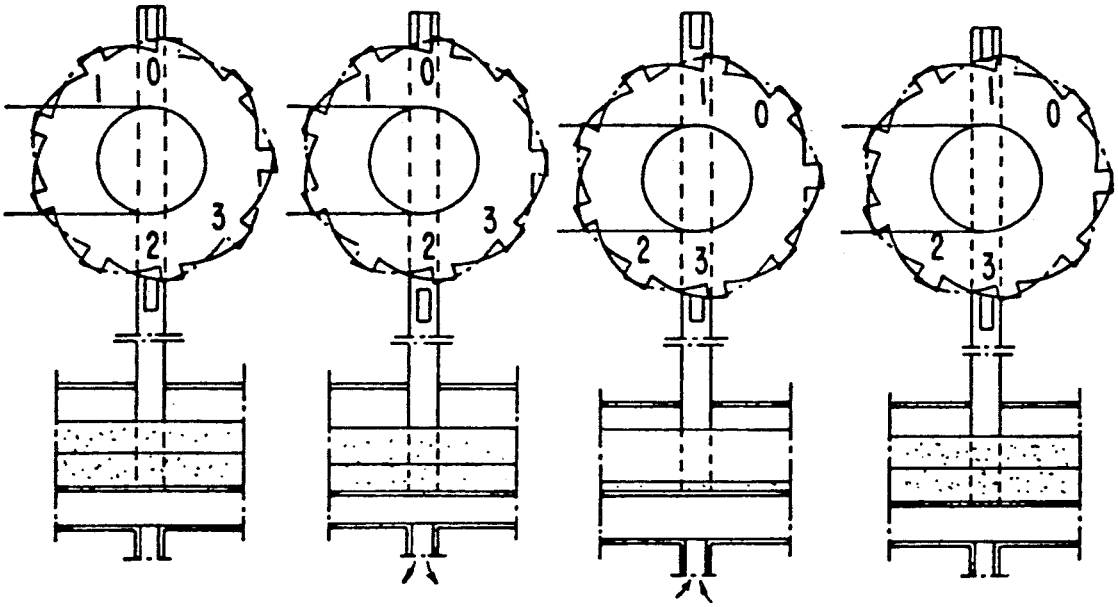
FIGS. 8A-8E show the principle of the function of the locking device as the water level falls or the bridge is loaded.
Figure 8A:
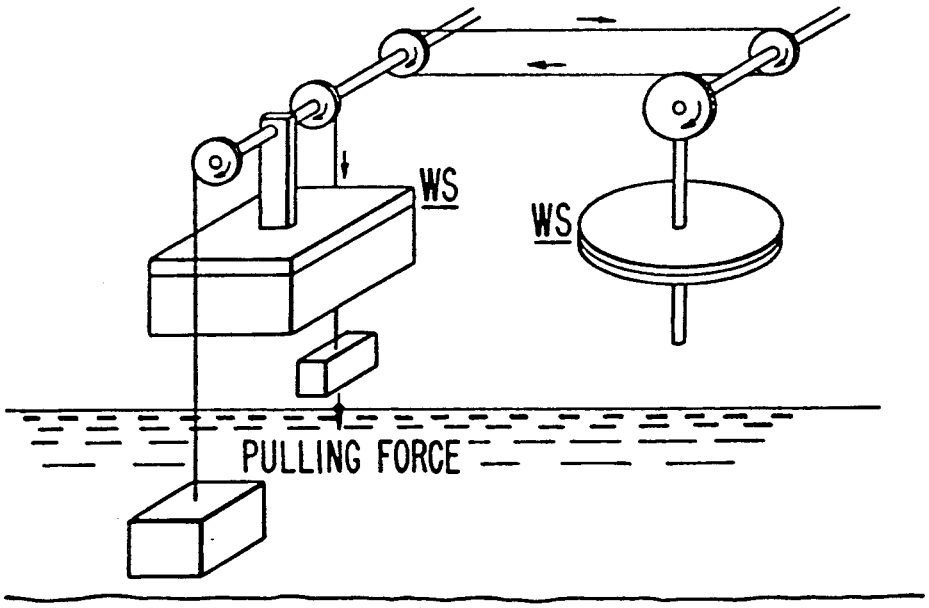

With reference to FIGS. 8A–8E, the function as the water level sinks is illustrated. FIG. 8B shows the initial state when the bridge is freely floating and there is no engagement between the lock means and the teeth of the ratchet wheels. FIGS. 8C–8E show what occurs as the water surface sinks. The pulling force of the sinker causes rotation of the ratchet wheels such that the lower lock means is brought into engagement. As the water surface sinks, the float pulls down the lock means until the lower locks means is moved out of engagement and the ratchet wheels can begin to rotate (FIG. 8C). The bridge together with the ratchet wheels and the float casing sink during the rotation of the ratchet wheels (FIG. 8D). The float remains on its level of altitude, since the upper lock means is fed upwards by the upper teeth to the same extent as the ratchet wheel sinks Some water will then be sucked into the float casing. During the rotation, the upper lock means is pressed against the upper teeth, but when the lock means has passed the edge of the teeth, the float is unprevented from sinking, while the water level rises. Finally, the float reaches its balanced position and the water surface in the float casing has taken the same position as the surrounding water surface (FIG. 8E). The bridge is again freely floating, but on a level which has fallen by the height of a tooth. If the water surface continues to sink, the procedure will be repeated.

Under effective load, i.e. when a load is applied to the bridge, the bridge will be pressed down. The pressing down of the bridge implies that an upward pressure is exerted on the float. The ratchet wheels will rotate such that the lock means takes the position shown in of FIG. 6C. The lock means remains in this position until the bridge has been unloaded.

Figure 9A:
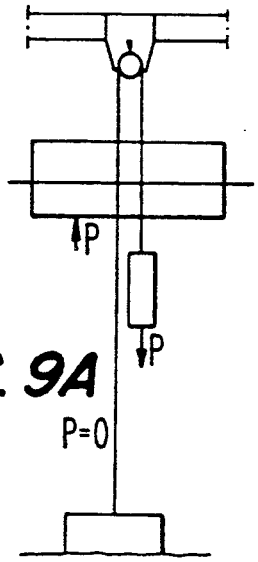
FIGS. 9A-9I illustrate in principle the stress occurring under different conditions.
Figure 9B:
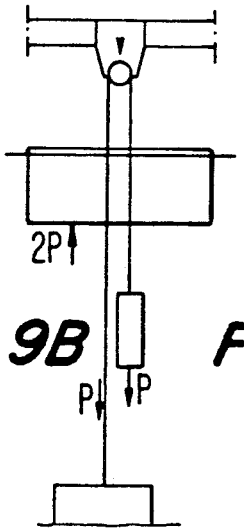
Figure 9C:
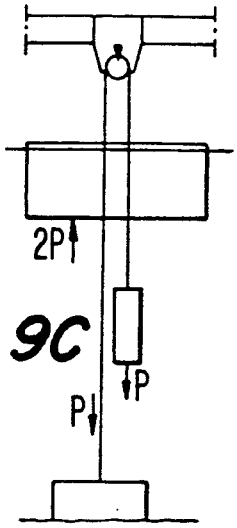
Figure 9D:
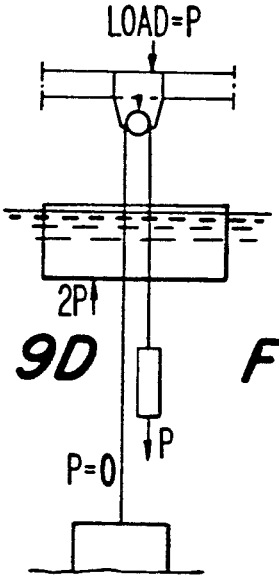
Figure 9E:
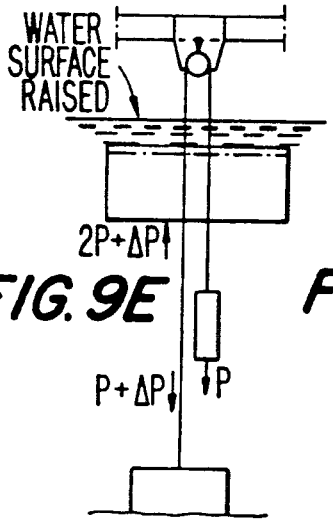
Figure 9F:
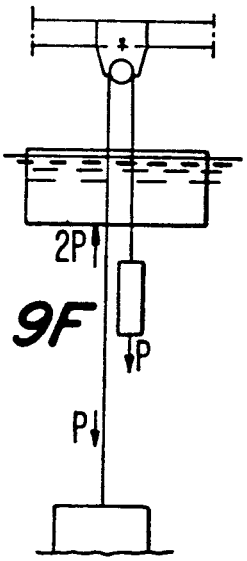
Figure 9G:
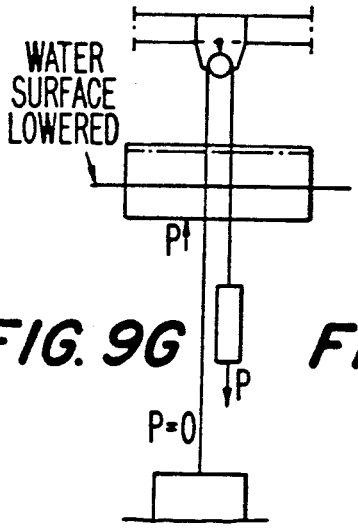
Figure 9H:
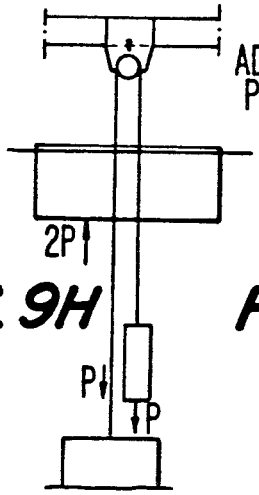
Figure 9I:
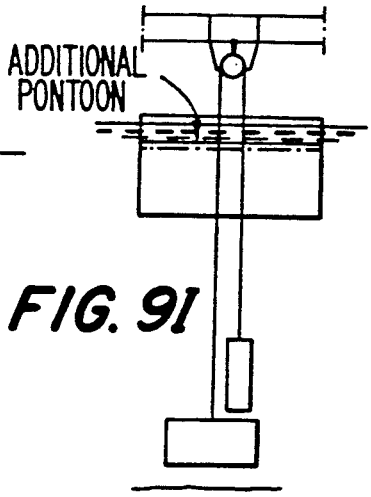

FIGS. 9A–9I show schematically the forces acting on the bridge under different conditions of load. FIGS. 9A–9C show left-to right how the bridge is anchored, the locking device first being locked. The upward pressure exerted on the pontoons, i.e. the lifting force, is P and the downwardly directed force, i.e. the weight of the bridge and the sinkers, is also P, which means that the tension in the anchor cable is 0. Subsequently, the locking means is released and the bridge is clamped down and the pontoons sink until they support the load 2P (FIG. 9B), whereupon the sinkers are locked in their new position (FIG. 9C). FIG. 9D shows the case when a load P is applied to the bridge. As the load is applied to the bridge, the tension in the anchor cables is reduced. When the tension is 0, the maximum load P has been applied. FIGS. 9E and 9F show what happens as the water level rises. The rising water level supplies the addition $\Delta P$ to the lifting force of the pontoons, and the bridge automatically takes its new level of altitude in the manner described in connection with FIGS. 7A–7E. FIGS. 9G and 9H show in a corresponding manner what happens as the water level sinks. Finally, FIG. 9I shows schematically how the anchors can readily be hoisted, for example to prevent the bridge from being damaged by moving ice in winter. Additional pontoons are inserted between the upper side of the ordinary pontoons and the lower side of the superstructure. As a result, the bridge can follow the motions of the ice. The weight which is to be hoisted constitutes the difference between the weight of the anchors and the weight of the sinkers, and therefore a minor amount of power is required.

The bridge according to the invention is, of course, not restricted to the embodiment described above and shown in the drawings, but can be modified in various ways. Thus, in the embodiment shown the pulleys 4 for the anchor cables are as large as the pulleys 5 for the sink cables. For a certain load, a fixed tension in the anchor cables is required which yields a corresponding torque in the pulleys of the anchor cables. The necessary torque is produced by the weight of the sinkers and depends on the radius of the pulleys of same diameter, the bridge will move to the same extent as the water level rises or sinks, but the sinkers will move twice this difference in height, since the sink cables are wound up or unwound to the same extent as the bridge moves upwards or downwards. When the bridge is laid in deep water, the pulleys of the sink cables can, however, be made considerably larger than the pulleys of the anchor cables. The motion of the sinkers will then to a corresponding degree be much bigger than the motion of the bridge. This means that the weight of the sinkers can be reduced. The portion of the pontoons which is used to support the sinkers can then also be reduced to the same extent. When the bridge is laid in shallow water, the condition will be reversed, i.e. the pulleys of the sink cables must be smaller than the pulleys of the anchor cables. This means heavier sinkers and larger pontoons than if the pulleys are of the same size. A more complicated design is to provide the pulleys of the sink cables with a gear, e.g. a planetary gear, which may give a ratio in the available space, which is higher than if the diameters of the pulleys are changed.

We claim:

1. A clamped-down bridge comprising a superstructure (1) supported by pontoons (2), each end of said bridge being fixedly secured to the bottom by means of anchors (3) and anchor cables and clamped down to the expected minimum load by means of sinkers (10) and sink cables, the anchor cables and the sink cables being wound in pairs onto a common shaft (6) in such manner that winding up of the sink cables causes unwinding of the anchor cables, and vice versa, characterised in that said shafts (6) are, by motion transfer means (7, 8, 9 13, 25), connected with each other and with an automatic locking device (11) which comprises ratchet wheels

(12) actuated by said motion transfer means and having two juxtaposed sets of opposed teeth, and a locking bar (15) which is vertically displaceable by a float (16) and provided with lock means (14) which on vertically opposite sides of said ratchet wheels (12) engage with the teeth thereof.

2. The bridge as claimed in claim 1, characterised in that said float (16) is mounted in a freely moving manner in a float casing (18) which is fixedly connected with said bridge.

3. The bridge as claimed in claim 1, characterised in that said float casing (18) is provided with guide means (20) for said locking bar (15).

4. The bridge as claimed in claim 2, characterised in that said float casing (18) is provided with a downwardly directed inlet and outlet pipe (21).

5. The bridge as claimed in claim 4, characterised in that the cross-sectional dimension of said inlet and outlet pipe (21) is such that the inflow and outflow of water in the float casing (18) is restricted.

6. The bridge as claimed in claim 4, characterised in that the lower part of said inlet and outlet pipe (21) is provided with a sieve (22).

7. The bridge as claimed in claim 1, characterised in that said float (16) is provided with a weight (17) to give said float the correct buoyancy.

8. The bridge as claimed in claim 1, characterised in that said motion transfer means comprise chain gears (7) which are mounted on the shafts (6) and transfer, by means of chains (8, 25) and cables (9), the rotary motion of the shafts to said ratchet wheels (12).

9. The bridge as claimed in claim 1, characterised in that said locking device (11) is mounted substantially in the centre of the bridge.

* * * * *